United States Patent [19]

Herrmann

[11] 4,372,472

[45] Feb. 8, 1983

[54] TAPE DISPENSER

[76] Inventor: Fred Herrmann, 330 Main St., Dickson City, Pa. 18519

[21] Appl. No.: 250,885

[22] Filed: Apr. 3, 1981

[51] Int. Cl.[3] ..... B26D 1/02

[52] U.S. Cl. ..... 225/80; 225/25; 225/90; 225/91

[58] Field of Search ..... 225/80, 88, 90, 91, 225/47, 25

[56] References Cited

U.S. PATENT DOCUMENTS

| | | | |
|---|---|---|---|
| 740,389 | 10/1903 | Blue | 225/88 X |
| 2,447,145 | 8/1948 | Van Cleef et al. | 225/80 |
| 3,707,251 | 12/1972 | Dashnier et al. | 225/88 X |

*Primary Examiner*—Frank T. Yost

*Attorney, Agent, or Firm*—Edmund M. Jaskiewicz

[57] ABSTRACT

A dispenser for tapes packaged in a roll and having an adhesive on one side thereof has a pair of spaced parallel sidewalls upstanding from the base and a mounting disk is rotatably positioned upon a shaft extending between the centers of the sidewalls. A roll of tape is mounted on the mounting disk. There is a cutter edge at an upper corner of the housing between the sidewalls and there is a rotatable roller positioned below and inwardly of the cutter edge but above a radius extending from the center shaft to the cutter edge. The roller has a helical thread thereon so as to provide a moving point contact for the adhesive surface of the tape moving thereover. As the adhesive side of the tape passes over the roller and below the cutter edge, the tape can be pulled out to a desired length and then cut along its non-adhesive surface by being moved upwardly against the cutter edge.

12 Claims, 9 Drawing Figures

TAPE DISPENSER

The present invention relates to a dispenser for tapes and the like, more particularly, to such a dispenser wherein a roll of tape having an adhesive on one side thereof is pulled from the roll in a path above a roller and below a cutter edge.

A wide variety of tapes including tapes having an adhesive on one side thereof, such as masking tapes and drafting tapes, are packaged in roll form for convenience in handling and for using the tape. Many structures and devices have been proposed to facilitate and assist in the dispensing of such tapes. A tape dispenser may generally comprise a frame in which a roll of tape is removably mounted, some form of guide structure to guide the end of the tape which is to be used and some form of a cutting device which severs the tape to the desired length.

The guide structure may comprise various kinds of rollers or stationary guide surfaces. The cutting device may range from a single stationary blade having a cutting edge over which the tape is moved to sever the tape to the desired length or to various forms of cutting and knife structures which must be positively actuated in order to produce the cutting action.

An ever present problem in such tape dispensers is to assure the location of the end of the tape in order to enable the tape to be pulled to the desired length and then be severed. In order to facilitate finding the free end of the tape, many tape dispensers use a cutting device which cuts the tape on its adhesive side and the adhesive is then relied upon to stick to the cutting edge so that the free end of the tape is supposed to be always present on the cutting edge.

Another problem in many tape dispensers is that it becomes more difficult to pull tape from the roll as the roll becomes used. The previously known structures for guiding the tape from the partially used roll to the cutting device generally did not take into consideration the fact that the tape originates from different points as the roll becomes used. Thus, it becomes more difficult to pull the tape through or over the various guiding structures as the tape becomes used and, as a result, the tape may be cut unevenly or may be torn as the user tries to unwind the tape. Accordingly, many guide structures have been devised in an attempt to overcome this problem, but these guide structures tend to become rather complex such that they are not economically feasible for use in simple, inexpensive tape dispensers.

It is therefore the principal object of the present invention to provide a novel and improved tape dispenser.

It is another object of the present invention to provide a dispenser for tapes having adhesive on one side thereof which has an improved structure for guiding the tape from the roll to the cutting edge.

It is a further object of the present invention to provide such a tape dispenser which provides for ease in locating the free end of the tape.

It is an additional object of the present invention to provide a tape dispenser which provides greater ease and time saving in dispensing a number of small strips of tape, such as might be used in drafting operations.

According to one aspect of the present invention such a tape dispenser may comprise a dispensing frame which includes a pair of spaced parallel like sidewalls upstanding from a base. Each sidewall is substantially square in shape and there is a shaft between the centers of the sidewalls. A disk is rotatably positioned on the shaft and a roll of tape is mounted on the disk. There is a cutter edge at an upper corner of the dispensing frame and positioned between the sidewalls. A rotatable roller has means thereon to define a moving point contact and is positioned above a radius extending from the center shaft to the cutter edge and closely spaced from the largest diameter of a roller of tape carried on the shaft and mounting disk. An adhesive side of the tape passes over the roller and below the cutter edge such that the tape can be pulled out to a desired length and then cut by the non-adhesive side of the tape being moved upwardly against the cutter edge.

The cutter edge is preferably positioned inwardly of the vertical edge of the dispensing frame and is set at an angle with respect to the base. The dispensing frame and base and mounting disk of the dispenser may be made in transparent material so that the amount of tape on the roll can be viewed at all times.

Other objects and advantages of the present invention will be apparent upon reference to the accompanying description when taken in conjunction with the following drawings, which are exemplary, wherein.

Proceeding next to the drawings wherein like reference symbols indicate the same parts throughout the various views a specific embodiment and modifications of the present invention will be described in detail.

Figure 1:
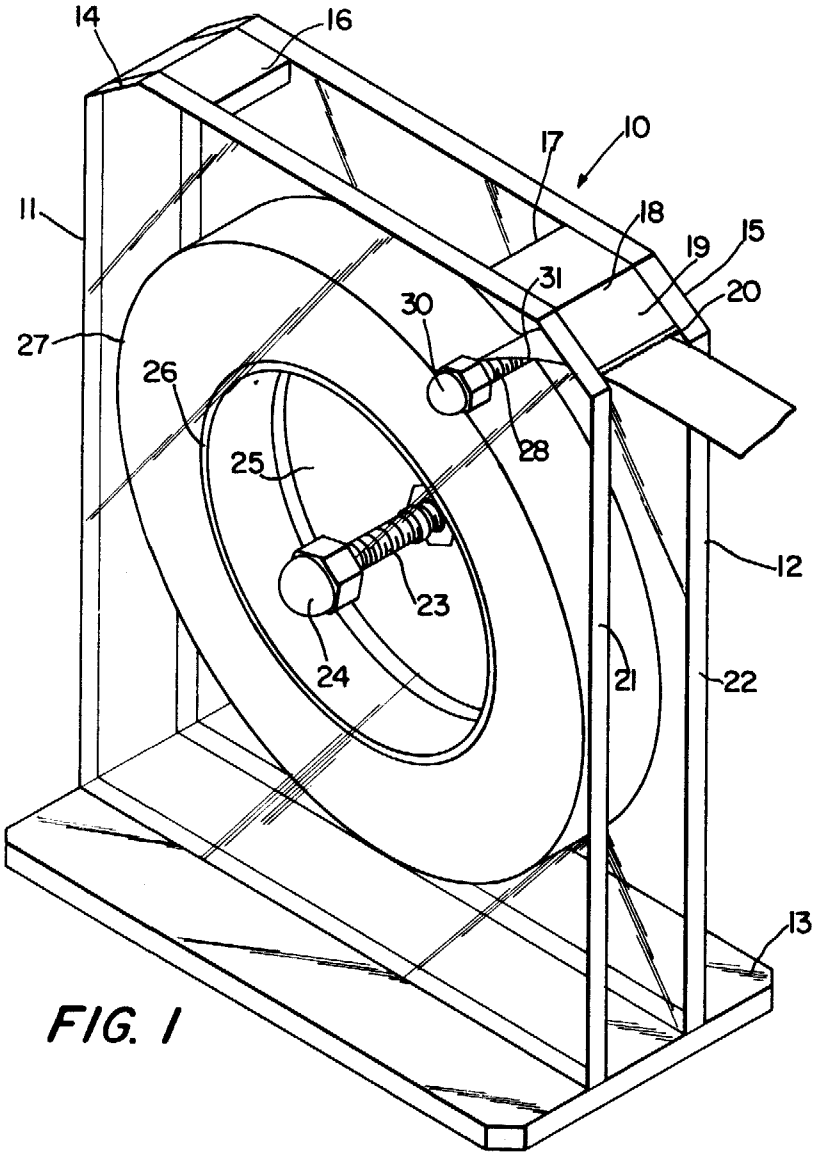
FIG. 1 is an overall perspective view of the tape dispenser according to the present invention.
Figure 3:
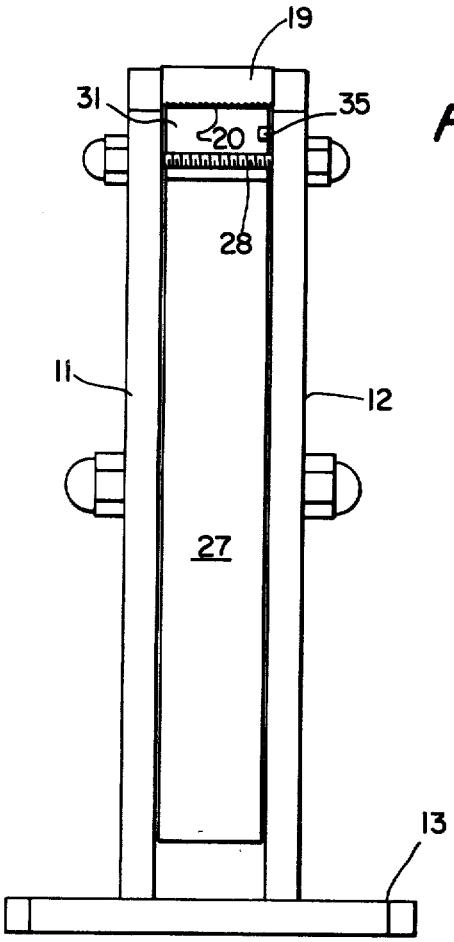
FIG. 3 is a front-elevational view of the dispenser looking at the cutter edge.
Figure 4:
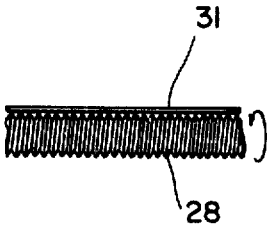
FIG. 4 is a front-elevational view in enlarged scale of the helical roller used in the tape dispenser.
Figure 5:
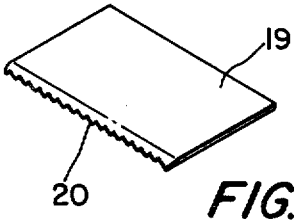
FIG. 5 is a top plan view of the cutter blade showing the directional tooth pointing.

As may be seen in FIG. 1, the tape dispenser comprises a dispensing frame indicated generally at 10 which comprises a pair of spaced parallel substantially square sidewalls 11 and 12 upstanding from a base 13. The sidewalls 11 and 12 are identical and their upper corners 14 and 15 are beveled at an angle of approximately 30° with respect to the base 13. Spacing blocks 16 and 17 are between the upper corners of the sidewalls 11 and 12 and are secured to the sidewalls so as to maintain their spaced relationship.

The spacer block 17 which has a sloping or beveled surface 18 has affixed to this sloping surface 18 a cutting blade 19 along the cutter edge 20 of which are positioned directioned teeth. The cutter edge teeth 20 are positioned inwardly of the vertical sidewalls 21 and 22 of the dispensing frame.

The cutting blade 19 is preferably made of an alloy steel and has a directional tooth pointing so as to permit ease of cutting and straightness of cut. The cutting edge is slightly recessed from the vertical sidewalls of the dispensing frame so that the tape is never exposed beyond the sidewalls of the frame and the squareness of the cut is assured at all times.

A center stem or shaft 23 passes through bores formed in the centers of the sidewalls 21 and 22 and the shaft 23 consists of a threaded nylon shaft on the ends of which are threaded acorn nuts 24.

A circular mounting disk 25 is mounted on the shaft 23 and has an outer diameter which is slightly smaller than a core 26 of a roll of tape 27 which is mounted in the dispenser so as to slidably accommodate the core.

A roller 28 is rotatably mounted between the sidewalls 11 and 12 below and inwardly of the cutter edge 20 and above a radius 29 which extends from a center bore in one of the sidewalls 11 and 12 to the cutter edge 20. The location of the roller 28 may deviate vertically A and horizontally B from the position illustrated. The roller 28 consists of a nylon shaft having a helical thread thereon which may range from No. 4–40 to No. 10–32. This helical thread of the shaft 28 provides a moving point contact which facilitates movement of the adhesive edge of the tape over the roller in the manner to be presently described, and determines the proper angle for pulling tape from its roll, even as the size of the roll decreases.

The roller 28 is secured in position by acorn nuts 30 threaded on its ends extending beyond the outer surfaces of the sidewalls 11 and 12.

For tapes having an adhesive on one side thereof, and particularly for drafting tapes which have a controlled adhesive "tack," the force required to pull the tape from a roll mounted in the dispenser will increase slightly as the size of the roll decreases during use because of the angularity of the force vectors. The controlled adhesive "tack" also provides the easiest tension pull. Since the smallest diameter 31 is the worst condition under which tape must be pulled from the roll, the helical roller 28 must be as close as possible to the largest diameter 32 of the roll without actually touching the roll of tape. In this particular embodiment, the center of the roller is disposed about ⅛" beyond the outer diameter 32 of the full roll of tape.

Figure 2:
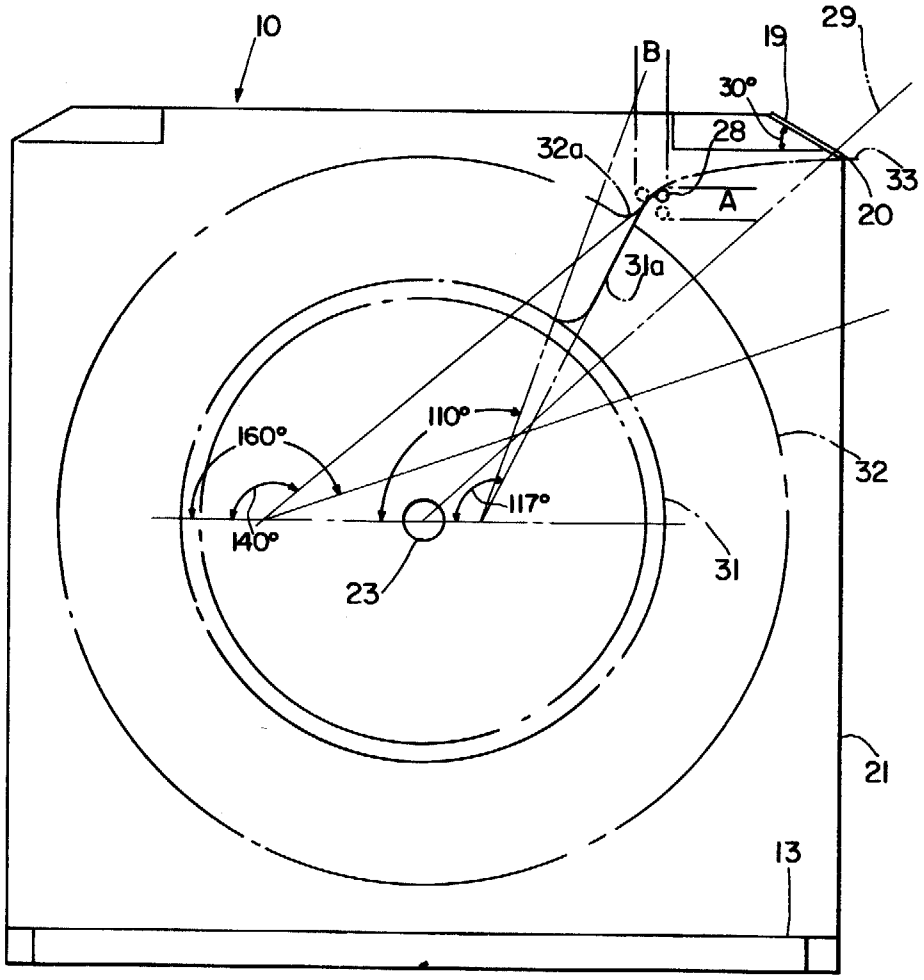
FIG. 2 is a side-elevational view of the tape dispenser of FIG. 1.

The tape being pulled from the roll must make an angle greater than 110° and less than 160° with a line through the center of a sidewall and parallel to the base 13 under all conditions of the roll—the angles being as indicated in FIG. 2. In the embodiment shown in FIG. 2 the tape 32*a* is pulled from a full roll 32 at an angle of about 140° and at 31*a* being pulled from an almost empty roll 31 at an angle of about 117°.

Figure 6:
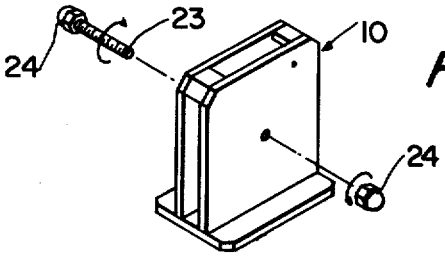
FIG. 6 is a perspective view partially exploded to illustrate the mounting of the center shaft.
Figure 7:
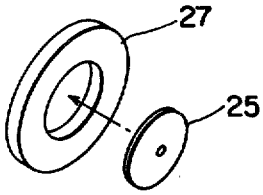
FIG. 7 is an exploded perspective view of a roll of tape and mounting disk.
Figure 8:
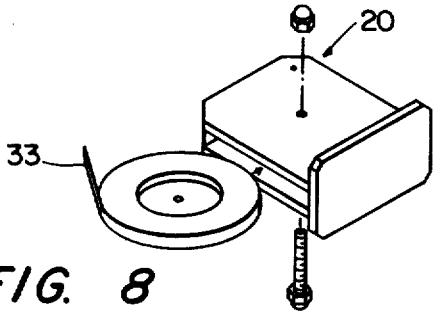
FIG. 8 is a perspective view of the tape dispenser positioned on its side to facilitate insertion of a new roll of tape.

In order to load the dispenser with a roll of tape, an acorn nut 24 is removed from one end of the shaft 23 and the shaft 23 is removed together with the mounting disk 25 as shown in FIG. 6. The mounting disk 25 is then placed into the core of a roll of tape as shown in FIG. 7 and the tape and mounting disk are slipped into the dispensing frame as in FIG. 8. The center shaft is then replaced and the acorn nut threaded on the exposed end of the shaft. The end of the tape 33 should be directed from the roll of tape as shown in FIG. 8 and the tape end 33 is threaded over the helical roller 28 but below the cutting edge 20 in the manner as shown in FIG. 9.

Figure 9:
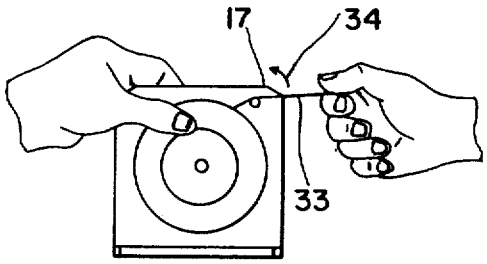
FIG. 9 is a side-elevational view showing the manner in which tape is withdrawn from the dispenser.

Since the adhesive side of the tape is directed downwardly immediately behind and below the cutting edge 20 the tape can be pulled from the roll merely by inserting the index finger against the adhesive side of the tape and then pulling the tape outwardly with the index finger and the thumb in the manner as shown in FIG. 9. The tape is then pulled upwardly in the direction of the arrow 34 so that the non-adhesive side of the tape is pulled against the cutting edge 20 and the tape is then cut to its desired length.

When the tape is being unrolled from the roll over the roller 28, the tape will not stick to the roller because the helical threads on the roller will be constantly moving laterally of the tape as the roller is rotated during the movement of the tape over the roller. The helical shape of the thread will then automatically free the roller from the adhesive side of the tape.

After cutting a length of tape, the end of the tape will be automatically positioned beneath the spacer block 17 and immediately behind the cutting edge 20 so as to be easily located for its next use.

The above-described embodiment of a tape dispenser was specifically constructed for use in drafting operations during which was intended to hold a ¾" wide, 60 yd. long, 3" core drafting tape. Accordingly, the described embodiment of the tape dispenser had square sides which measured approximately 5⅝" along each side and was spaced sufficiently to readily accommodate the ¾" wide roll of tape.

The sidewalls 11 and 12, the base 13, the mounting disk 25 and the spacer blocks 16 and 17 are preferably constructed of a clear transparent material such as Lucite or plexiglass which is preferably ¼" thick. The various components are attached or bonded to each other in the manner known in the art.

While the above-described embodiment was particularly intended for drafting tapes, other tapes of similar size including masking tape or filament tape can effectively be used in this tape dispenser.

The tape dispenser can also be constructed in a smaller form to accommodate smaller rolls of tape such as might be used in the home or office. Such a small roll of tape may comprise a transparent tape ¾" wide and 36 yds. long mounted on a 1" diameter core. To accommodate such a tape roll the sidewalls 11 and 12 would still be square but would measure approximately 3½" along each side. In such a smaller sized dispenser it is preferable to offset the center bores in the sidewalls about ⅛" from the center along the horizontal axix in a direction away from the cutter edge. The offsetting of the shaft in this manner will enable the above established conditions of unwinding to occur with the small roll of tape.

The tape dispenser can be modified by providing a lip or rib 35 at the mouth of the dispenser and extending inwardly toward the center of the dispenser substantially parallel to the base 13. This rib prevents the tape from sticking to itself due to static electricity which may occur since the tape is plastic.

The transparent sidewalls of the tape dispenser provide clear visibility of the tape at all times so that one can readily ascertain the amount of tape remaining on the roll. At the same time, the sidewalls protect the sides of the tape roll from picking up any dirt or dust particles due to some glue exposure.

The tape dispenser stands upright on a working surface, such as a drafting board and is thus conveniently located for use at all times while at the same time being decorative.

The entire dispenser unit can be washed with soap and water whenever the need should arise since the shafts are made of nylon and the remainder of the dispensing frame is made from a plastic material.

It will be understood that this invention is susceptible to modification in order to adapt it to different usages and conditions and, accordingly, it is desired to comprehend such modifications within this invention as may fall within the scope of the appended claims.

What is claimed is:

1. A dispenser for tapes comprising a base, a dispensing frame having a pair of spaced parallel like sidewalls upstanding from said base and each sidewall being substantially square in shape, a shaft between the centers of said sidewalls, a mounting disk on said shaft to carry a roll of tape thereon, a cutter edge at an upper corner of said housing and between said sidewalls, a rotatable roller having means thereon for defining a moving point contact and disposed above a radius extending from said center shaft to said cutter edge and closely spaced from the largest diameter of a roll of tape carried on said shafts and mounting disk, an adhesive side of said tape passing over said roller and below said cutter edge whereby the tape can be pulled out from the roll at an angle between 110° and 160° to a desired length outwardly of the dispenser and then cut by its non-adhesive side being moved upwardly against said cutter edge.

2. A dispenser as claimed in claim 1 wherein said sidewalls and said mounting disk are of a transparent material.

3. A dispenser as claimed in claim 1 wherein said cutter edge is positioned inwardly of the vertical edge of said dispensing frame.

4. A dispenser as claimed in claim 3 wherein said cutter edge is disposed at a 30° angle with respect to said base.

5. A dispenser as claimed in claim 1 and further comprising spacer blocks between the upper corners of said sidewalls away from said base.

6. A dispenser as claimed in claim 5 wherein an outer edge of a said spacer block is beveled and a cutter being mounted on said beveled edge.

7. A dispenser as claimed in claim 1 wherein said center shaft is removable.

8. A dispenser as claimed in claim 3 wherein said cutter edge comprises directional tooth pointing.

9. A dispenser as claimed in claim 1 wherein said roller has a helical thread thereon.

10. A dispenser as claimed in claim 9 wherein said roller is of a rust-free material.

11. A dispenser as claimed in claim 1 wherein said roller is located below and inwardly of said cutter edge.

12. A dispenser as claimed in claim 1 and further comprising means for preventing the free end of the tape from sticking to itself.

* * * * *